US008322813B2

(12) United States Patent
Kasai et al.

(10) Patent No.: US 8,322,813 B2
(45) Date of Patent: Dec. 4, 2012

(54) DISCHARGE DEFECT DETECTING METHOD AND DISCHARGE DEFECT DETECTING DEVICE

(75) Inventors: Tsuneo Kasai, Azumino (JP); Hidekuni Moriya, Chino (JP); Kenji Fukasawa, Cupertino, CA (US)

(73) Assignee: Seiko Epson Corporation, Tokyo (JP)

( * ) Notice: Subject to any disclaimer, the term of this patent is extended or adjusted under 35 U.S.C. 154(b) by 431 days.

(21) Appl. No.: 12/750,598

(22) Filed: Mar. 30, 2010

(65) Prior Publication Data

US 2010/0253982 A1 Oct. 7, 2010

(30) Foreign Application Priority Data

Apr. 1, 2009 (JP) ..... 2009-089378

(51) Int. Cl.
*B41J 29/393* (2006.01)

(52) U.S. Cl. ..... 347/19

(58) Field of Classification Search ..... 347/19
See application file for complete search history.

(56) References Cited

U.S. PATENT DOCUMENTS

| | | | | |
|---|---|---|---|---|
| 7,726,760 | B2 * | 6/2010 | Ikefuji et al. | 347/19 |
| 2006/0274106 | A1 * | 12/2006 | Park | 347/19 |
| 2007/0120885 | A1 * | 5/2007 | Jeong | 347/19 |
| 2010/0079774 | A1 * | 4/2010 | Yamazaki | 358/1.5 |
| 2011/0069894 | A1 * | 3/2011 | Vans et al. | 382/218 |

FOREIGN PATENT DOCUMENTS

| | | | |
|---|---|---|---|
| JP | 2008-064486 | A | 3/2008 |
| JP | 2009-012335 | A | 1/2009 |

* cited by examiner

*Primary Examiner* — Julian Huffman
(74) *Attorney, Agent, or Firm* — Kilpatrick Townsend & Stockton LLP

(57) ABSTRACT

A discharge defect detecting device including a sensor that reads image, which has been formed on a medium by moving nozzles relative to the medium in a relative movement direction and discharging a fluid, at a reading resolution lower than the resolution of an image data in the relative movement direction, based on the image data; a standard data forming unit that forms a standard data having the same resolution as the reading resolution in the relative movement direction, based on the image data; and a detecting unit that compares a plurality of the reading data pixels on the same row in the relative movement direction in the data read by the sensor with a plurality of standard data pixels each corresponding to the plurality of the reading data pixels in the standard data, to detect the discharge defects of the nozzles.

8 Claims, 13 Drawing Sheets

DISCHARGE DEFECT DETECTING METHOD AND DISCHARGE DEFECT DETECTING DEVICE

CROSS REFERENCES TO RELATED APPLICATIONS

The disclosure of Japanese Patent Application No. 2009-089378 filed Apr. 1, 2009 including specification, drawings and claims is incorporated herein by reference in its entirety.

BACKGROUND

1. Technical Field

The present invention relates to a discharge defect detecting method and a discharge defect detecting device.

2. Related Art

There are techniques in which an image, which has been formed on a medium by discharging a fluid while nozzles move relative to the medium based on image data, is read with a sensor, standard data with the same resolution as the reading resolution is written based on the image data, and the data read by the sensor is compared with the standard data to detect discharge defects of the nozzles. For example, JP-A-2008-64486 discloses a technique for printing images which compares a standard image with an inspection image to detect defects.

In the related art, however, there is a problem in that a false detection may be occurred in the discharge defect detection.

SUMMARY

Advantages of some aspects of the invention is to prevent false detection in the discharge defect detection.

A discharge defect detection method according to an aspect of the invention includes the steps of reading an image, which has been formed on a medium by discharging a fluid with nozzles which are being moved relative to a medium in a relative movement direction, with a sensor so that a reading resolution is lower than resolution of the image data in the relative movement direction based on the image data, forming a standard data having the same resolution as the reading resolution in the relative movement direction based on the image data, comparing a plurality of reading data pixels on the same row in the relative movement direction in the data read by the sensor with the plurality of standard data pixels corresponding to the plurality of the reading data pixels in the standard data to detect the discharge defects of the nozzles.

Other aspects of the invention are clarified by the description of the specification and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
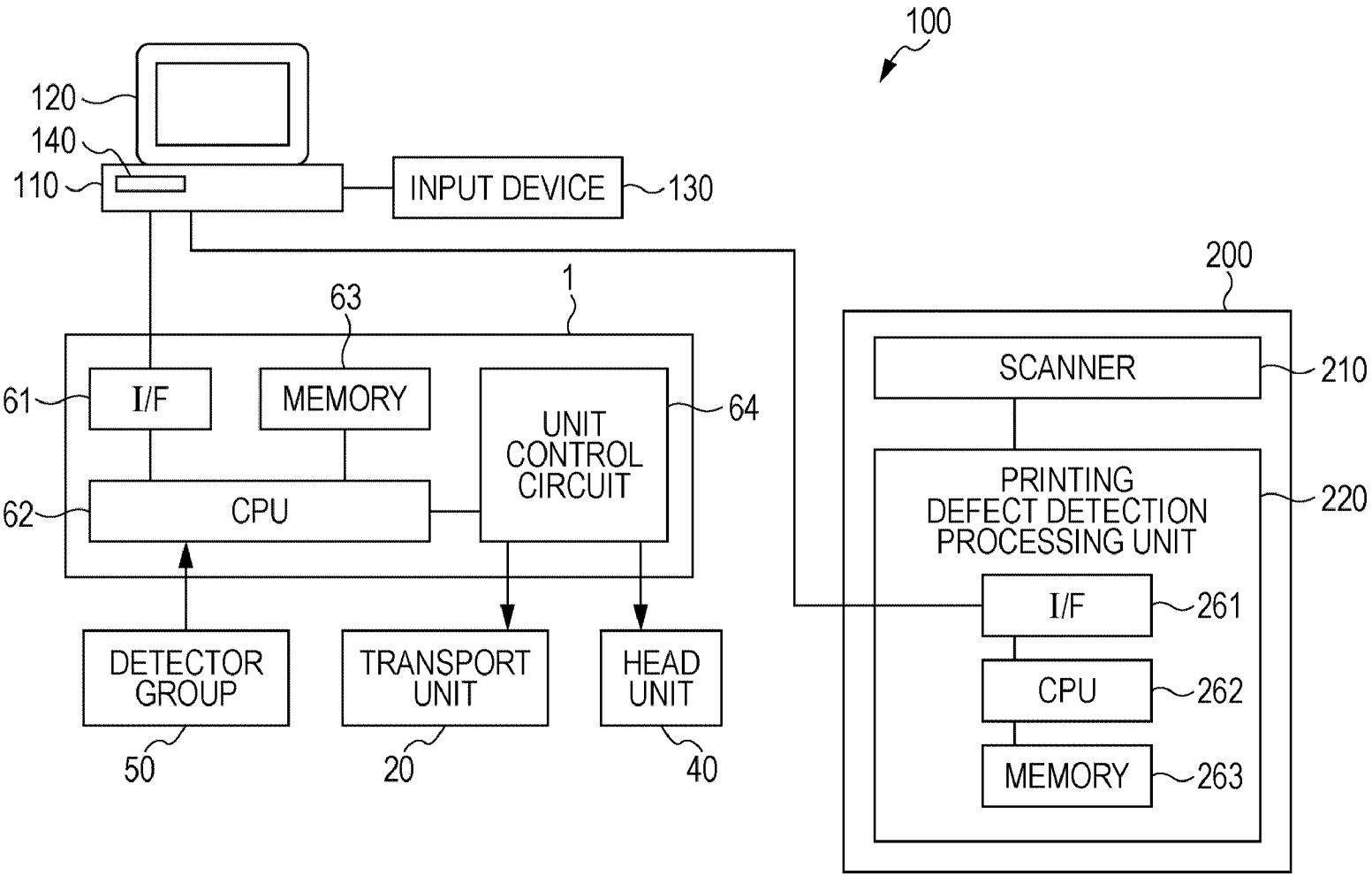
FIG. 1 is a block diagram showing a structure of a printing system used in one embodiment of the invention.

By means of the description of the specification and the description of the accompanying drawings, at least the followings are obvious.

Namely, a discharge defect detection method of the invention includes the steps of reading an image, which has been formed on a medium by discharging a fluid with nozzles being moved relative to the medium in a relative movement direction, with a sensor so that reading resolution is lower than the resolution of the image data in the relative movement direction, based on image data, forming a standard data having the same resolution as the reading resolution in the relative movement direction based, comparing a plurality of reading data pixels on the same row in the relative movement direction in the data read by the sensor with the plurality of standard data pixels corresponding to the plurality of the reading data pixels in the standard data so as to detect the discharge defect of the nozzles.

For each raster line corresponding to each nozzle, the discharge defects of the nozzles are judged based on the detection results from the plurality of reading lines so that false detection can be prevented.

In addition, according to this discharge defect detection method, the data processing amount in the discharge defect detection can be reduced, while maintaining accuracy of the discharge defect detection.

In the discharge defect detecting method, by performing the comparison of the plurality of the reading data pixels on the same row in the relative movement direction with the plurality of the standard data pixels corresponding to the plurality of the reading data pixels for all of the rows, discharge defects of the nozzles are detected.

According to this discharge defect detecting method, whether discharge defects exist or not can be detected for all of the nozzles.

In the discharge defect detecting method, when the reading data pixels are compared with the standard data pixels to detect the discharge defects of the nozzles, difference between the pixel values of the plurality of the reading data pixels on the same row in the relative movement direction and the pixel values of the plurality of the standard data pixels corresponding to the plurality of the reading data pixels is calculated, and in cases where, among the calculation object pixels which are objects of the calculation of the differences, the ratio of calculation object pixels, where the difference is equal to or larger than a first predetermined value, is equal to or larger than a predetermined ratio, it is judged that discharge defects exist in the nozzles.

According to this discharge defect detecting method, a false detection due to reading errors of the sensor or the like can be prevented.

In the discharge defect detecting method, when it is judged that discharge defects exist in the nozzles, among the plurality of the standard data on the same row in the relative movement direction, the larger the ratio of the standard data pixels in which the pixel value is equal to or smaller than a second predetermined value, the larger the predetermined ratio is.

According to this discharge defect detecting method, it is possible to adjust the discharge defect detecting method to correspond with the shading of the image.

In the discharge defect detecting method, the sensor reads so that the reading resolution is higher than the resolution of the image data in a direction intersecting with the relative movement direction.

According to this discharge defect detecting method, when the discharge defects occur, it is possible to detect the nozzle in which the discharge defects occur.

In the discharge defect detecting method, the standard data is formed by the data processing of the image data.

According to this discharge defect detecting method, it is possible to form standard data with sufficient accuracy so as to detect the discharge defects, and the discharge defects can be properly detected.

In addition, a discharge defect detecting device of another aspect of the invention includes a sensor that reads an image, which has been formed on a medium by discharging a fluid with nozzles which are being moved relative to the medium in a relative movement direction, so that a reading resolution is lower than the resolution of the image data in the relative movement direction, based on the image data; a standard data forming unit that forms the standard data having the same resolution as the reading resolution in the relative movement direction; and a detecting unit that compares a plurality of the reading data pixels on the same row in the relative movement direction in the data read by the sensor with a plurality of standard data pixels each corresponding to the plurality of the reading data pixels in the standard data so as to detect the discharge defects of the nozzles.

Since, with respect to each raster line corresponding to each nozzle, discharge defects of the nozzles are judged based on the detection results from the plurality of the reading lines, false detection can be prevented.

Furthermore, according to this discharge defect detecting device, it is possible to reduce the data processing amount in the discharge defects detection.

FIRST EMBODIMENT

The Overall Structure

FIG. 1 is a block diagram showing a structure of a printing system 100 which is used in one embodiment of the present invention. As shown in FIG. 1, this printing system 100 includes a printer 1, a computer 110, a display device 120, an input device 130, a recording and reproducing device 140, and a detecting device 200 as one example of a discharge defect detecting device. The printer 1 is a printing device for printing an image on a medium such as paper, cloth, film and the like. The computer 110 is connected to the printer 1 in a manner enabling communication therewith, and, in order to print an image in the printer 1, outputs the image data according to the image to be printed to the printer 1.

A printer driver is installed in the computer 110. The printer driver is a program for displaying a user interface in the display device 120 to convert image data output from an application program to image data for printing. This printer driver is recorded in a recording medium such as a flexible disk FD or a CD-ROM (a computer readable recording medium). In addition, it is possible to download this printer driver in the computer 110 via the internet. Furthermore, this program is constituted by codes for realizing various functions.

Structure of Printer 1

Figure 2:
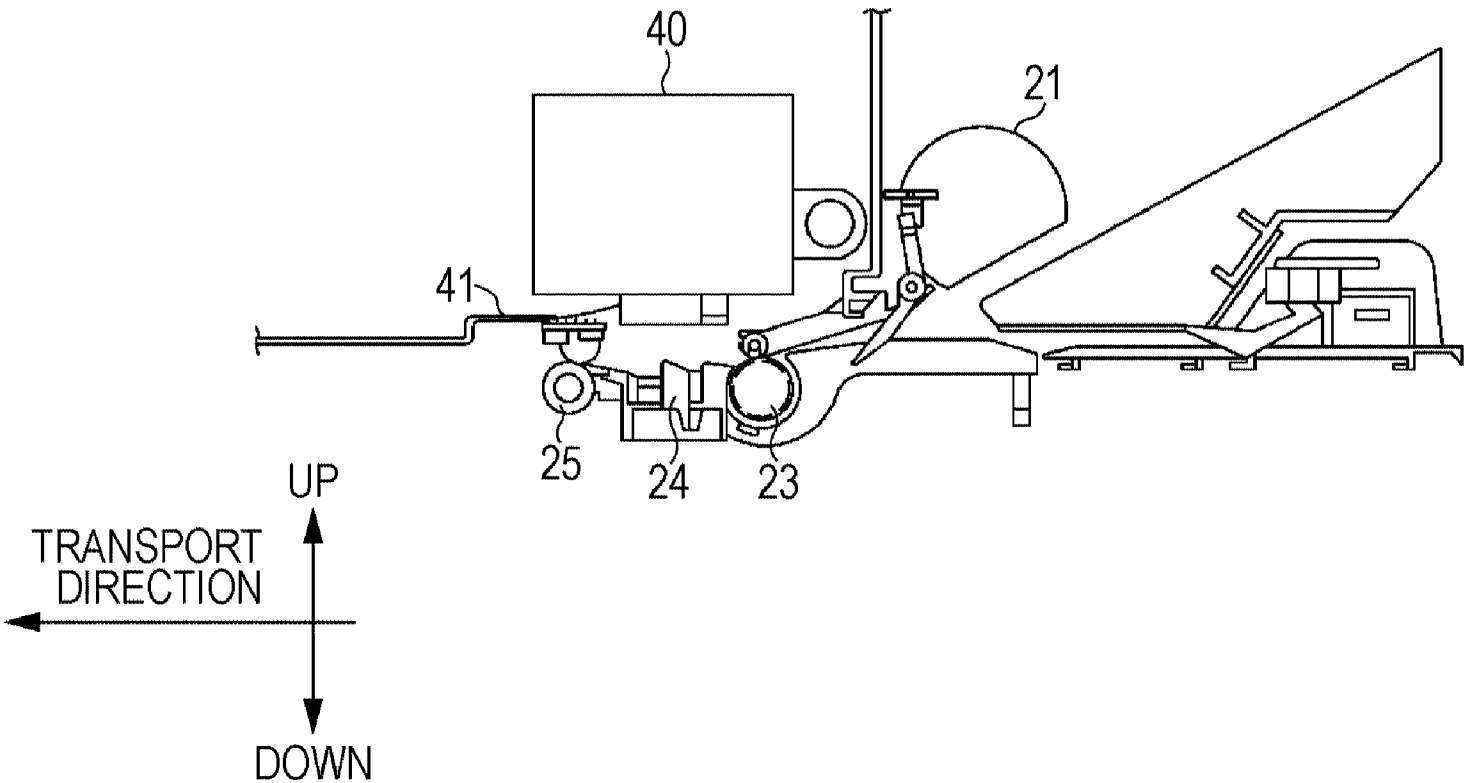
FIG. 2 is a sectional view of the overall structure of a printer.

FIG. 2 is a sectional view of the overall structure of the printer 1.

The printer 1 has a transport unit 20, a head unit 40, a detector group 50, and a controller 60. The printer 1, which has received image data from the computer 110 as the external device, controls each unit (the transport unit 20 and the head unit 40) by the controller 60. The controller 60 controls each unit on the basis of the image data received from the computer 110 and prints an image on the paper. The conditions in the printer 1 are monitored by the detector group 50, and the detector group 50 outputs the detecting results to the controller 60. The controller 60 controls each unit on the basis of the detection results output from the detector group 50.

The transport unit 20 is to transport a medium (e.g., a paper S or the like) in a transport direction. This transport unit 20 has a paper feeding roller 21, a transport motor (not shown), a transport roller 23, a platen 24, and a paper discharging roller 25. The paper feeding roller 21 is a roller for feeding the paper, which has been inserted into a paper insertion opening, into the printer. The transport roller 23 is a roller for transporting the paper S, which has been fed by the paper feeding roller 21 to a printable region and is driven by the transport motor. The platen 24 supports the paper S during printing. The paper discharging roller 25 is a roller for discharging the paper S to the outside of the printer and is disposed at the downstream in the transport direction relative to the printable region. This paper discharging roller 25 rotates synchronously with the transport roller 23.

In addition, when the transport roller 23 transports the paper S, the paper S is pinched between the transport roller 23 and a driven roller. As a result, the positioning of the paper S is stabilized. On the other hand, when the paper discharging roller 25 transports the paper S, the paper S is pinched between the paper discharging roller 25 and the driven roller.

The head unit 40 is to discharge an ink to the paper S. The head unit 40 forms dots on the paper S and prints images on the paper S by discharging the ink to the paper S during transport. The printer 1 is a line printer and the head unit 40 is capable of forming dots as much as a paper width at a time.

Figure 3:
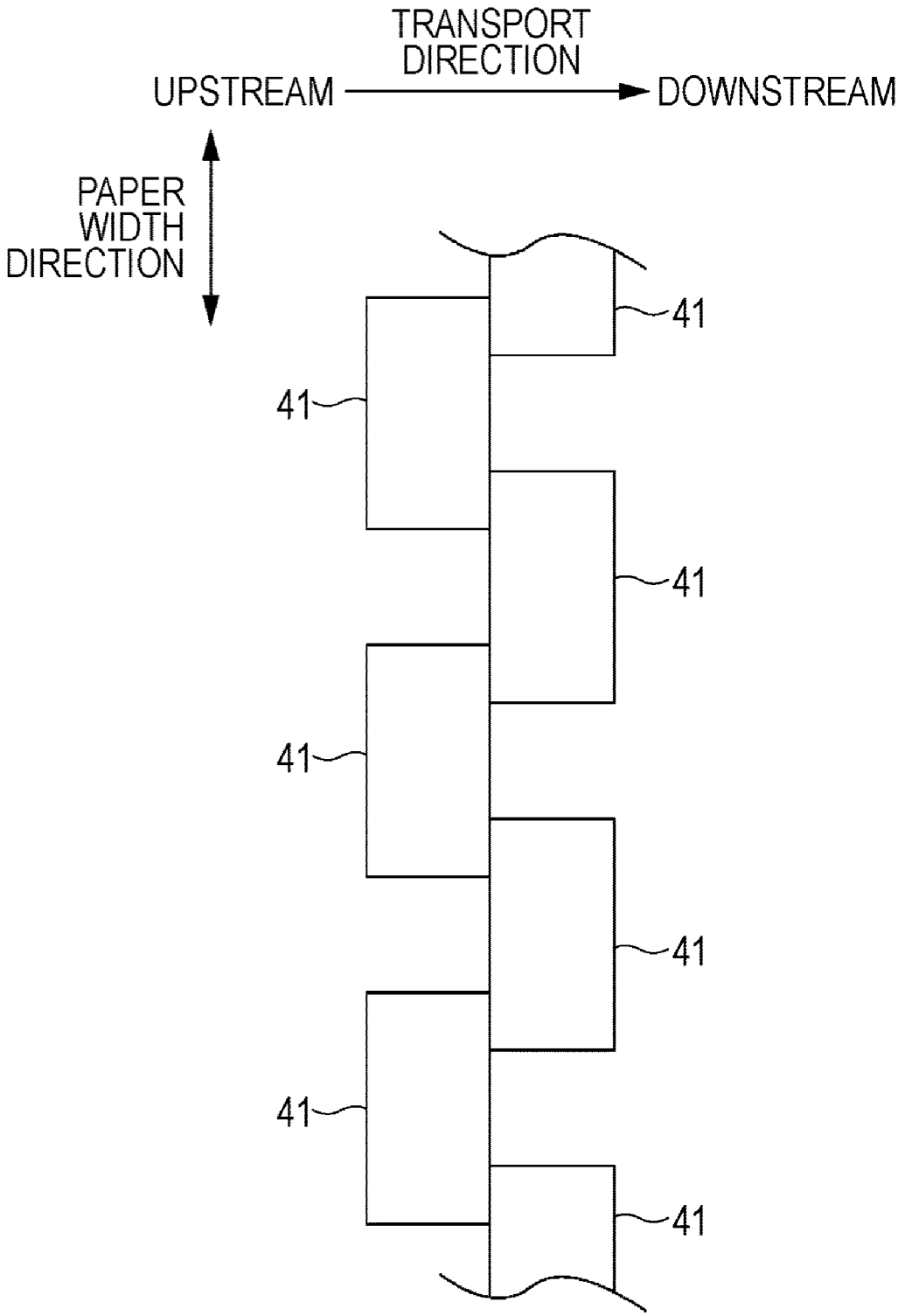
FIG. 3 is a diagram illustrating an arrangement of the plurality of heads in a lower face of a head unit.
Figure 4:
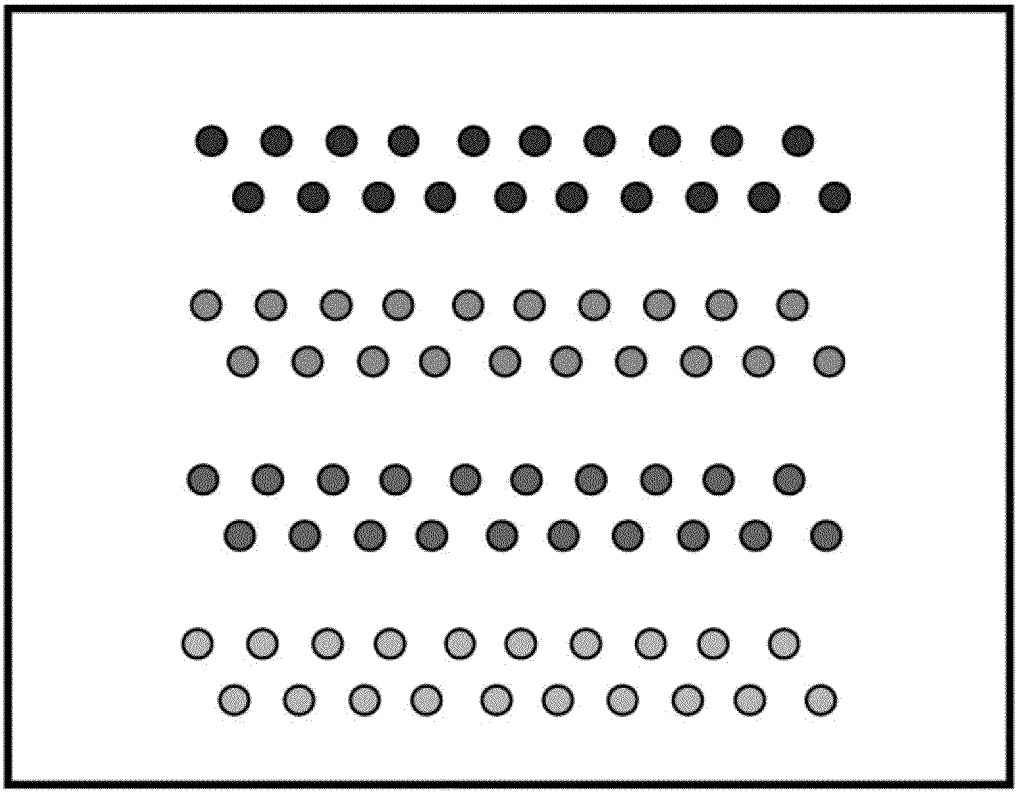
FIG. 4 is a diagram showing nozzle arrangements of a head.

FIG. 3 is a diagram illustrating arrangements of a plurality of heads in the lower face of the head unit 40. As shown in FIG. 3, a plurality of the heads 41 is arranged in a zigzag shape along the paper width direction. Furthermore, FIG. 4 is a diagram showing a nozzle arrangement of the heads 41. As shown in FIG. 4, each head 41 has a black ink nozzle row, a cyan ink nozzle row, a magenta ink nozzle row, and a yellow ink nozzle row formed therein. Each of the nozzle rows includes a plurality of nozzles for discharging inks. A plurality of the nozzles of each nozzle row is arranged at regular nozzle pitches along the paper width direction. Namely, a nozzle group as large as the paper width is constituted by the nozzle rows of each head 41.

Figure 5:
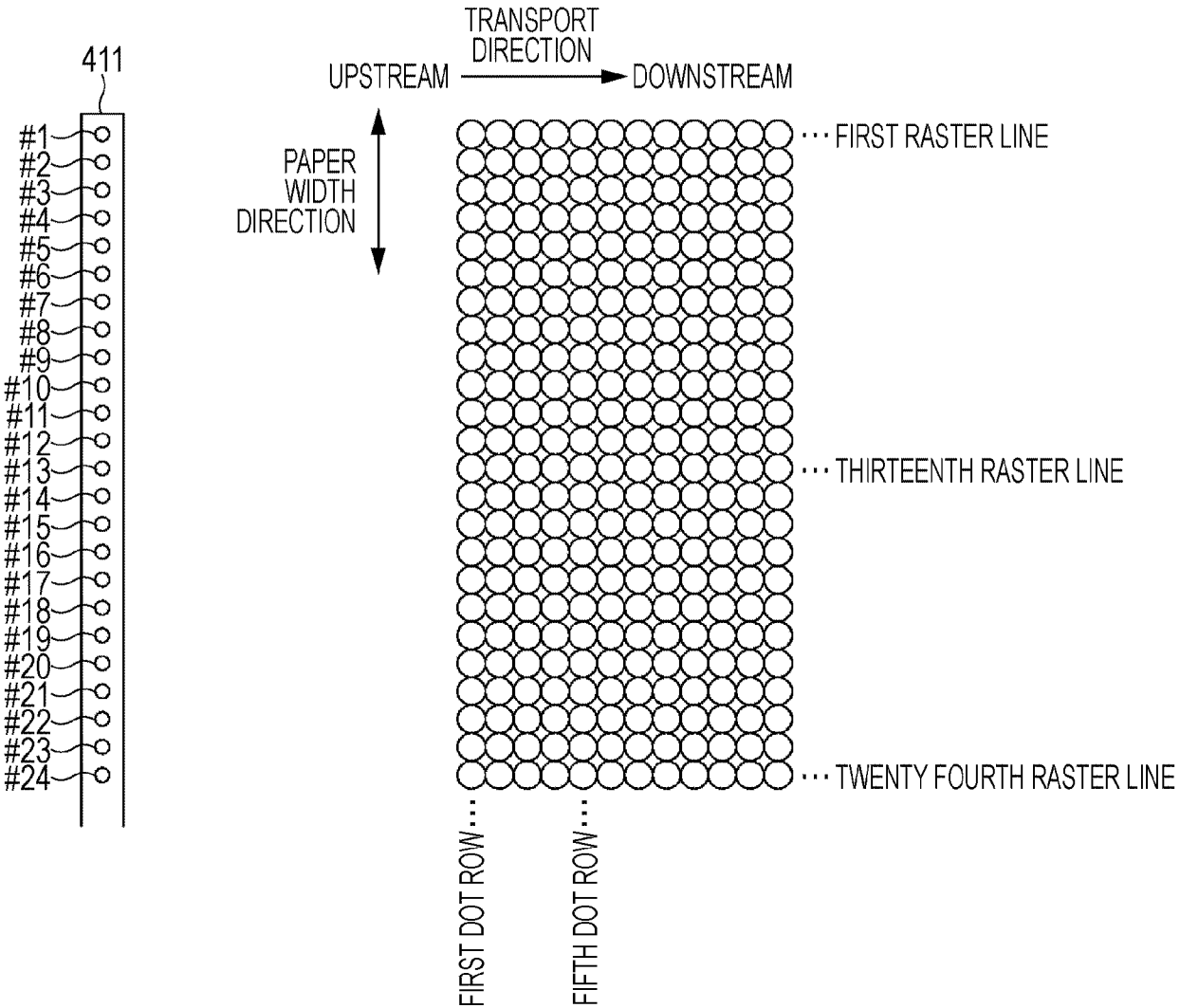
FIG. 5 is a diagram illustrating appearances of the nozzle arrangement and the dot forming for simple description.

FIG. 5 is a diagram illustrating appearances of a nozzle arrangement and dot forming for simple description. Herein, in the head unit 40, a nozzle group of a predetermined nozzle pitch is constituted by the nozzle rows of each head. The real positions of the nozzles differ in the positions in the transport direction as shown in FIGS. 3 and 4, but by making the discharging timings different, the nozzle group constituted by the nozzle rows of each head can be indicated as nozzles arranged in a row as shown in FIG. 5. In addition, to facilitate description, it is assumed that only the black ink nozzle group is provided.

The nozzle group is constituted by the nozzles arranged at intervals of 1/720 inches in the paper width direction. Each nozzle is numbered sequentially from the upper side in the drawings.

In addition, ink droplets are intermittently discharged from each nozzle to the paper S during transport, so that the nozzle group forms raster lines on the paper S. For example, nozzle #1 forms a first raster line on the paper S and nozzle #2 forms a second raster line on the paper S. Each raster line is formed along the transport direction. In the following description, a direction of the raster line is referred to as a raster direction (corresponding to "relative movement direction").

Figure 6A:
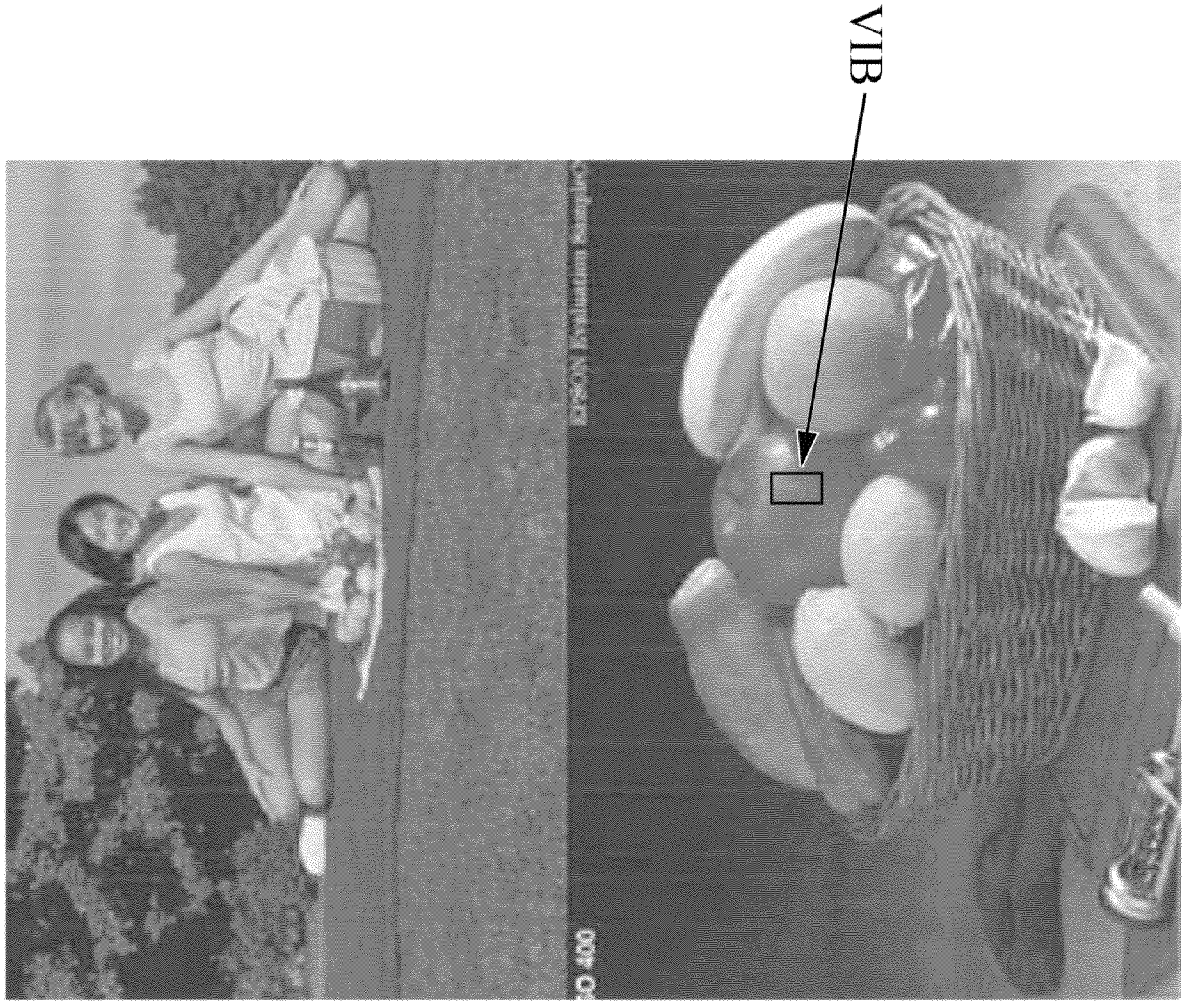
FIG. 6A is a diagram showing a printing image at the time of occurrence of the discharge defect.
Figure 6B:
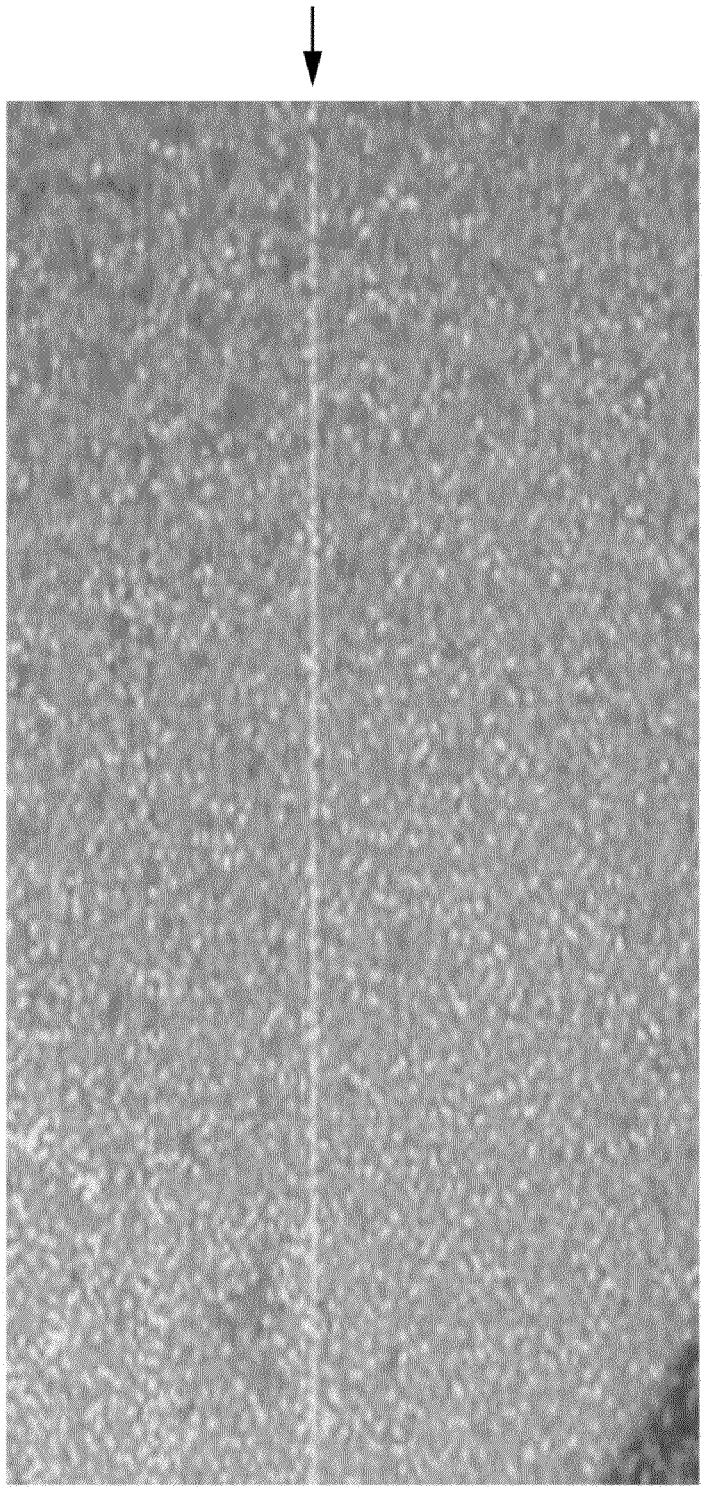
FIG. 6B is an enlarged view of the dot defect portion surrounded by a rectangular frame in FIG. 6A.

On the other hand, if the ink droplets are not properly discharged due to clogging of the nozzles or the like, proper dots are not formed on the paper S. In the following description, dots which are not formed properly are referred to as dot defects. If the discharge defects of the nozzles occur once, since it is difficult for the discharging to naturally recover during printing, the discharge defects occur successively. Then, the dot defects occur successively in the raster direction on the paper S, and the dot defects are observed as a white or light stripe on the printing image. FIG. 6A is a printing image when the discharging defect occur. In addition, FIG. 6B is an enlarged view of the dot defect positions surrounded by the rectangular frame in FIG. 6A. As indicated by the arrow in FIG. 6B, a white stripe is observed in the longitudinal direction.

The controller 60 is a control unit (controller) for controlling the printer 1. The controller 60 has an interface portion 61, a CPU 62, a memory 63, and a unit control circuit 64. The interface portion 61 sends and receives data between the computer 110 as the external device and the printer 1. The CPU 62 is an operation processing device for controlling the overall printer. The memory 63 is used to ensure regions for storing the programs of the CPU 62 and working regions and the like and has memory elements such as RAM and EEPROM. The CPU 62 controls each unit via the unit control circuit 64, according to the programs stored in the memory 63.

Structure of Detecting Device 200

As shown in FIG. 1, the detecting device 200 includes the scanner 210 as one example of the sensor and discharge defect detection processing portion 220.

The scanner 210 is a linear sensor type with photosensitive portions arranged in a line and reads the image printed on the paper S by the printer 1, while transporting the paper S in the raster direction. An illumination light reaches the reading portion of the scanner 210 so that the scanner 210 can read the image printed on the paper S. In addition, the scanner 210 has a width, which is capable of reading the image as much as the paper width of the paper S at a time, and the scanner is capable of reading all the colors, which can be printed by the printer 1, for each color.

The reading resolution in the paper width direction of the scanner 210 is higher than the resolution of the image printed on the paper S. Specifically, since, in the present embodiment, the resolution of the printed image is 720 dpi in the paper width direction, it is preferable that the reading resolution in the paper width direction of the scanner be 1440 dpi, which is twice the resolution of the printed image, or more, and the reading resolution, for example, is 1440 dpi.

On the other hand, with respect to the reading resolution in the raster direction of the scanner 210, it is read so as to be lower than the resolution of the image printed on the paper S. For example, if the transporting speed of the paper S is 254 mm/s and the time (one scanning period) required for reading the equivalent of one reading line is 7 ms, the paper S is transported by 1.78 mm during the reading. Namely, the width of one reading line becomes 1.78 mm. Namely, if the printing resolution in the raster direction is 1440 dpi, one reading line corresponds to 1.78 mm×1440 dpi=100.8 dots. Namely, the reading resolution in the raster direction of the reading data corresponds to the image compressed to about 1/100 from the printed image. Each reading line of the reading data is constituted by the pixel value in which the pixel values of about 100 dots of the printed image have been averaged in the raster direction for each color.

Figure 7:
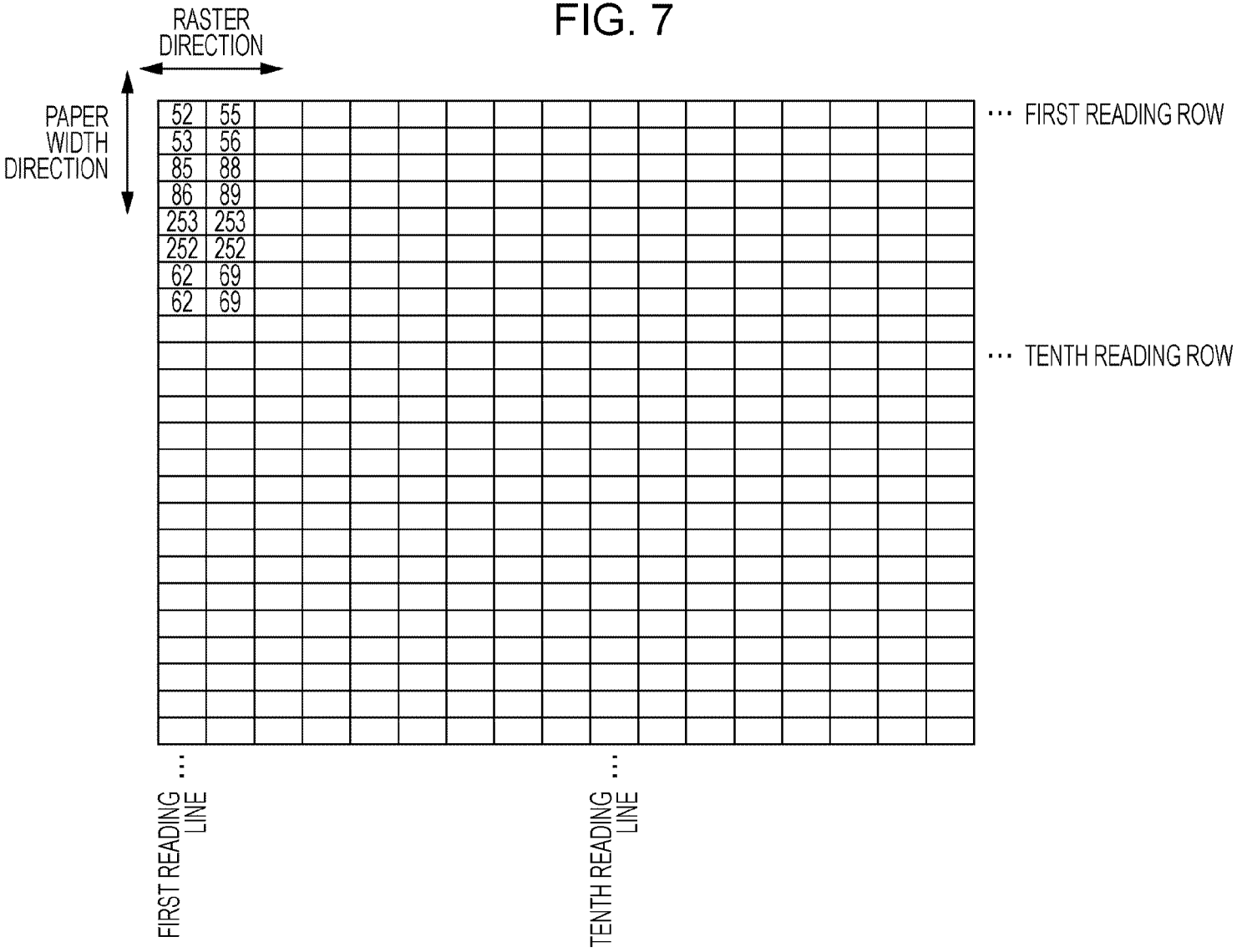
FIG. 7 is a diagram illustrating reading data read by a scanner when a scan rate is 7 ms.

FIG. 7 is a diagram illustrating the reading data read by the scanner 210 when the scan rate is 7 ms. As shown in FIG. 7, the reading data is the data connecting a position of the cell with the pixel value read at the position for a cell which has been partitioned into a quadrille shape in regards to the raster direction and the paper width direction. Hereinafter, for the purpose of description, as shown in FIG. 7, the rows in the raster direction are indicated in order from a first reading row to $1440^{th}$ reading row, and the lines in the paper width direction are denoted by the number in order of reading of the scanner 210 from a first reading line to an Nth reading line.

Figure 8A:
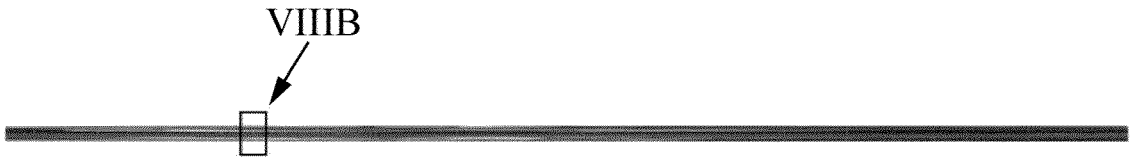
FIG. 8A is a diagram showing an image in which the printing image in FIG. 6A is read by the scanner.
Figure 8B:
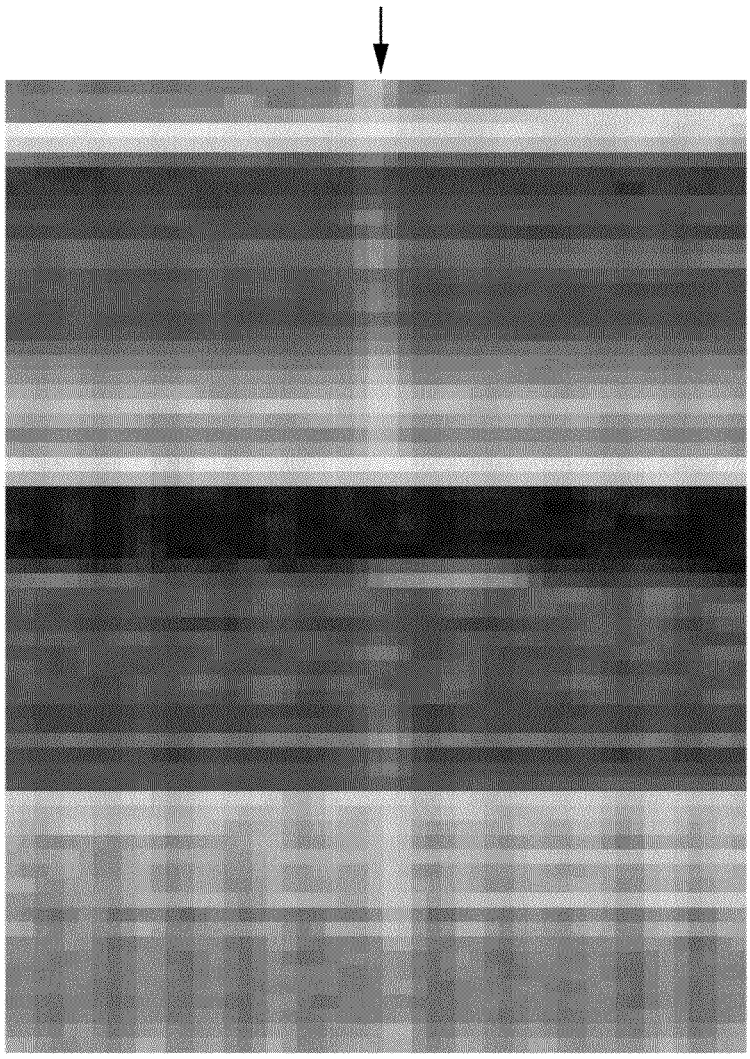
FIG. 8B is an enlarged view of the dot defect position surrounded by a rectangular frame in FIG. 8A.

In addition, FIG. 8A shows the printing image of FIG. 6A read by the scanner 210. As shown in FIG. 8A, an image read by the scanner 210 becomes an image compressed to about 1/100 in the raster direction. On the other hand, FIG. 8B is an enlarged view of dot defect positions surrounded by a rectangular frame in FIG. 8A. As indicated by the arrow in FIG. 8B, longitudinal white stripes are observed.

As shown in FIG. 1, the discharge defect detection processing portion 220 has an interface portion 261, a CPU 262, and a memory 263. The interface portion 261 sends and receives the data between the computer 110 as an external device and the detecting device 200. The CPU 262 is an operation processing device for controlling the overall printer. The memory 263 is to secure regions for storing programs of the CPU 262 and working regions or the like and has memory elements such as a RAM and an EEPROM. The CPU 262 processes the data according to the program stored in the memory 263.

The discharge defect detection processing portion 220 obtains data (reading data) of the image read by the scanner 210 and the image data from the printer 1 or the computer 110. The discharge defect detection processing portion 220 writes standard data having the same resolution as the reading resolution of the reading data, based on the resolution of the image data, and compares the reading data with the standard data to detect the discharge defects of the nozzles.

Nozzle Discharge Defects Detection Processing

Figure 9:
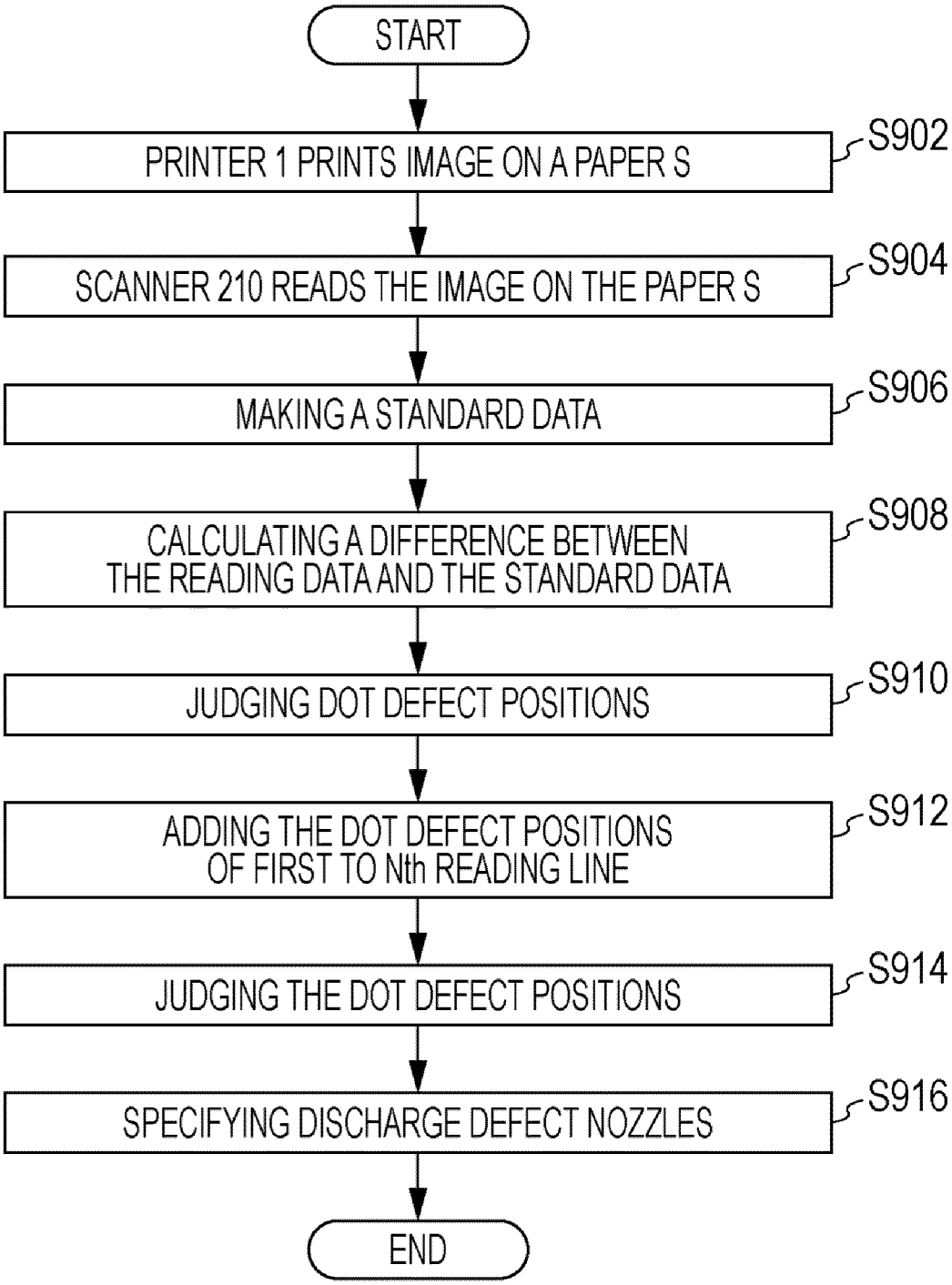
FIG. 9 is a diagram showing a flow of a discharge defect detection processing.

FIG. 9 is a diagram showing the flow of the discharge defect detecting processing.

First of all, the printer 1 prints on the paper S, on the basis of the image data received from the computer 110 (S902).

The scanner 210 reads the image printed on the paper S so that the reading resolution becomes lower than the resolution of the image data in the raster direction (S904). Concretely, the scan rate is set to be 7 ms, and the first reading line to the Nth reading line are read so that the first reading line corresponds to 100.8 dots.

The discharge defect detection processing portion 220 obtains the image data from the controller 60 or the computer 110 and performs digital processing of the image data, thereby writing standard data having the same resolution as the reading resolution of the reading data (S906). Concretely, with respect to the raster direction, since the first reading line corresponds to 100.8 dots, the dot corresponding to first reading line can be made, by adding the multiplication of the pixel value of $101^{st}$ dot by 8/10 to the sum of the pixel values of the first dot to the $100^{th}$ dot and dividing the value by 100.8. In addition, the standard data is made for each color. Furthermore, with respect to the paper width direction, since the reading resolution is 1440 dpi, by correcting the image data of 720 dpi for each color, it is converted to the resolution of 1440 dpi to write the standard data.

The discharge defect detection processing portion 220 calculates a difference in the pixel values for each color from the first to $1440^{th}$ reading rows, by subtracting the pixel value of the reading data from the pixel value of the standard data for each reading line from the first reading line to the Nth reading line (S908).

The discharge defect detection processing portion 220 judges the dot defect positions of each color on the basis of the difference in the calculated pixel values for each reading line from the first reading line to the Nth reading line (S910). Concretely, if the difference in the pixel values is equal to or smaller than a predetermined value α, it is judged that the dot defect position does not exist, and if the difference in the pixel values exceeds the predetermined value α, it is judged that the dot defect position exists.

If the dots are formed in a state of the image data without the discharge defects in the nozzles of the printer 1, the difference in the pixel values of the standard data and the reading data becomes zero in theory. On the other hand, if the discharge defects exist in the nozzles of the printer 1 and the nozzles do not form the dots, the pixel value of the image data for the dot defect position becomes zero in theory and the pixel value of the standard data is indicated by the difference as it is. Namely, if the difference in the pixel values is not zero in theory, there is a possibility of the dot defect. However, it is also possible that, due to influences such as the reading error of the scanner 210, dust settling on the paper S, and the intensity of the illumination light, even when the discharge defect does not exist, the difference may not become zero. Thus, in this embodiment, a value between the pixel value of the standard data, which is a theoretical difference when the dot defect exists, and zero, which is a theoretical difference when the dot defect does not exist, is the predetermined value α, and it is judged whether the dot defect exists or not for each reading row. The predetermined value α may be a fixed value and may be a predetermined ratio a of the pixel value of the standard data (for example, 80%).

The dot defect positions, which have been judged for each reading line from the first reading line to the Nth reading line, are summed up for every reading row (S912). For each reading row, among the reading lines of column N, when the ratio of the reading lines, where the difference is equal to or greater than the predetermined value α, is equal to or greater than a predetermined ratio b (e.g., 5%), it is judged that the dot defect exists in the reading row (S914). In addition, the larger the ratio of the standard data pixel in which the pixel value of the standard data pixel is equal to or smaller than a predetermined value β (corresponding to "second predetermined value"), the larger the predetermined ratio b is. Namely, when there are many dark positions in the colors of the images, since there are less reading lines with differences equal to or larger than the predetermined value α, the value of the predetermined ratio b is made to be large. On the other hand, when there are many light positions of the colors of the images, since the difference in small reading lines is equal to or larger than the predetermined value α, the value of the predetermined ratio b is made to be small.

It is judged that the discharge defects occur in the nozzles corresponding to the reading row where the dot defects exist (S916). Herein, the $m^{th}$ nozzle corresponding to the $n^{th}$ reading row where the dot defects exist can be specified as the following formula 1:

$$m = n \times (\text{image resolution of printing}/\text{reading resolution of printing}) \quad \text{(formula 1).}$$

As described above, according to the first embodiment, at the time of reading with the scanner 210, the reading resolution is made to be low for the raster direction, while maintaining the accuracy of the discharge defect detection, so that the amount of processing data in the discharge defect detection can be reduced.

As shown in FIG. 6B, when the discharge defects of the nozzles occur, the raster line of the dot defect becoming a white stripe or a light stripe is observed. In addition, as shown in FIG. 8B, even if the scanner 210 gathers and reads one hundred dots in the raster direction, the image is merely compressed in the raster direction and the white stripe or the light stripe is still observed. In view of the above, by compressing the data amounts in the raster direction, processing data amount in the discharge defect detection can be reduced.

In addition, according to the first embodiment, with respect to each raster line corresponding to each nozzle, the discharge defects of the nozzles are judged based on the detection results from the plurality of the reading lines, so that false detection can be prevented. Namely, in theory, since the dot defects occur over one page in the raster line corresponding to the clogged nozzle, by repeatedly inspecting the plurality of the reading lines for each raster line, the accuracy of the detection can be improved.

Furthermore, according to the first embodiment, even when there are influences such as the detection error of the scanner 210, dust attached to the paper S, and the intensity of the illumination light, false detection can be prevented.

Furthermore, according to the first embodiment, it is possible to control the discharge defect detecting method in accordance with the shading of the image. Namely, in the image with the dark tone, since the difference in many reading lines is equal to or larger than the predetermine value α, the value of the predetermined ratio b is made to be large. On the other hand, when there are many positions with the light colors of the images, since there are less reading lines with differences equal to or larger than the predetermined value α, the value of the predetermined ratio b is made to be small.

On the other hand, the reading resolution in the paper width direction is made to be higher than the resolution of printing, so that the nozzles with the discharge defect can be specified.

The invention is useful for mass printing for business use, for example. If printing is continued in a state of the discharge defects of the nozzles, a large amount of faulty prints are made. However, if the invention is used, the discharge defects of the nozzles can be detected during printing, so that when the discharge defect occurs, printing can be immediately stopped. In addition, if cleaning and flushing of the head are performed to solve the discharge defects such as clogging of the nozzles, printing can be rapidly restarted.

Furthermore, in order to further reduce processing data amount, the discharge defect detection is not performed for the overall prints, but the detection may be performed in the ratio of once per several times. If the frequency of the detection is made to be low, processing data amount can be reduced accordingly.

SECOND EMBODIMENT

While the line printer has been used in the first embodiment, a serial type printer is used in a second embodiment.

The printing system 100 used in the second embodiment includes, similar to the first embodiment, the printer, the computer 110, the display device 120, the input device 130, the recording and reproducing device 140, and the detecting device 200.

Figure 10A:
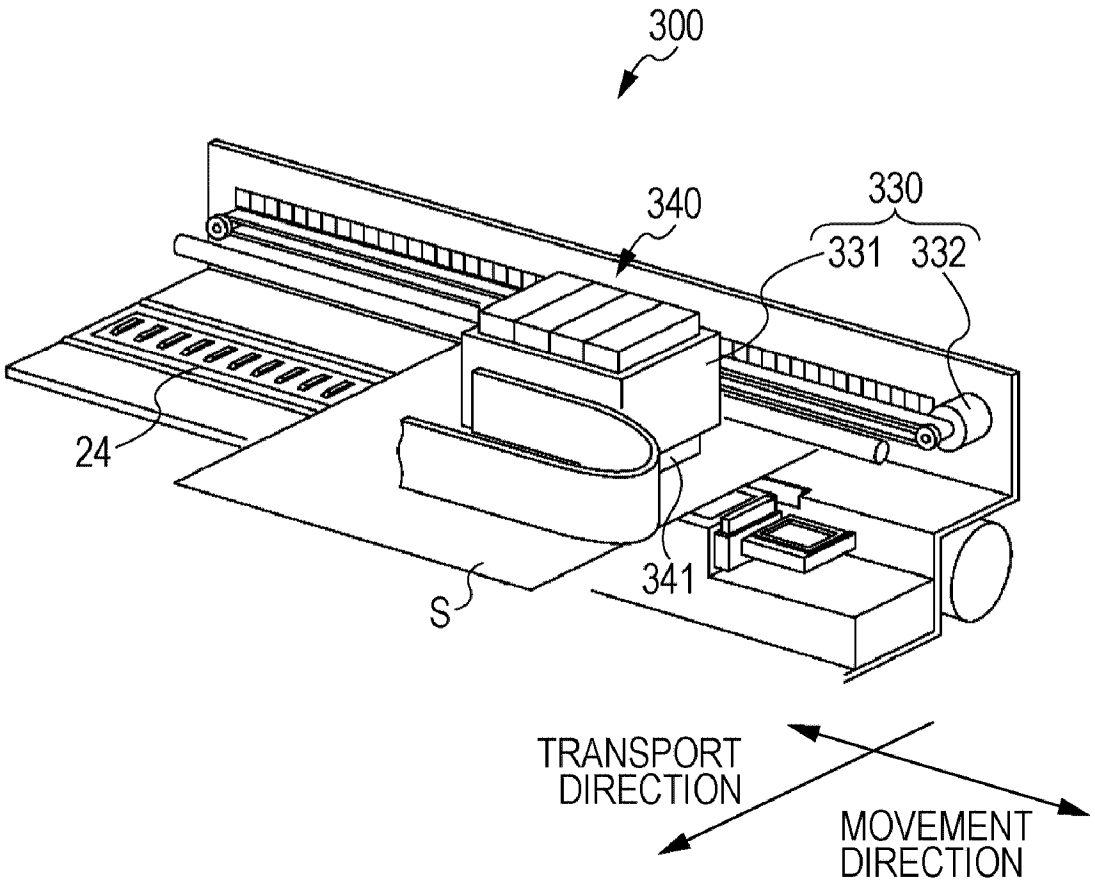
FIG. 10A is a schematic view of the overall structure of a serial type printer.
Figure 10B:
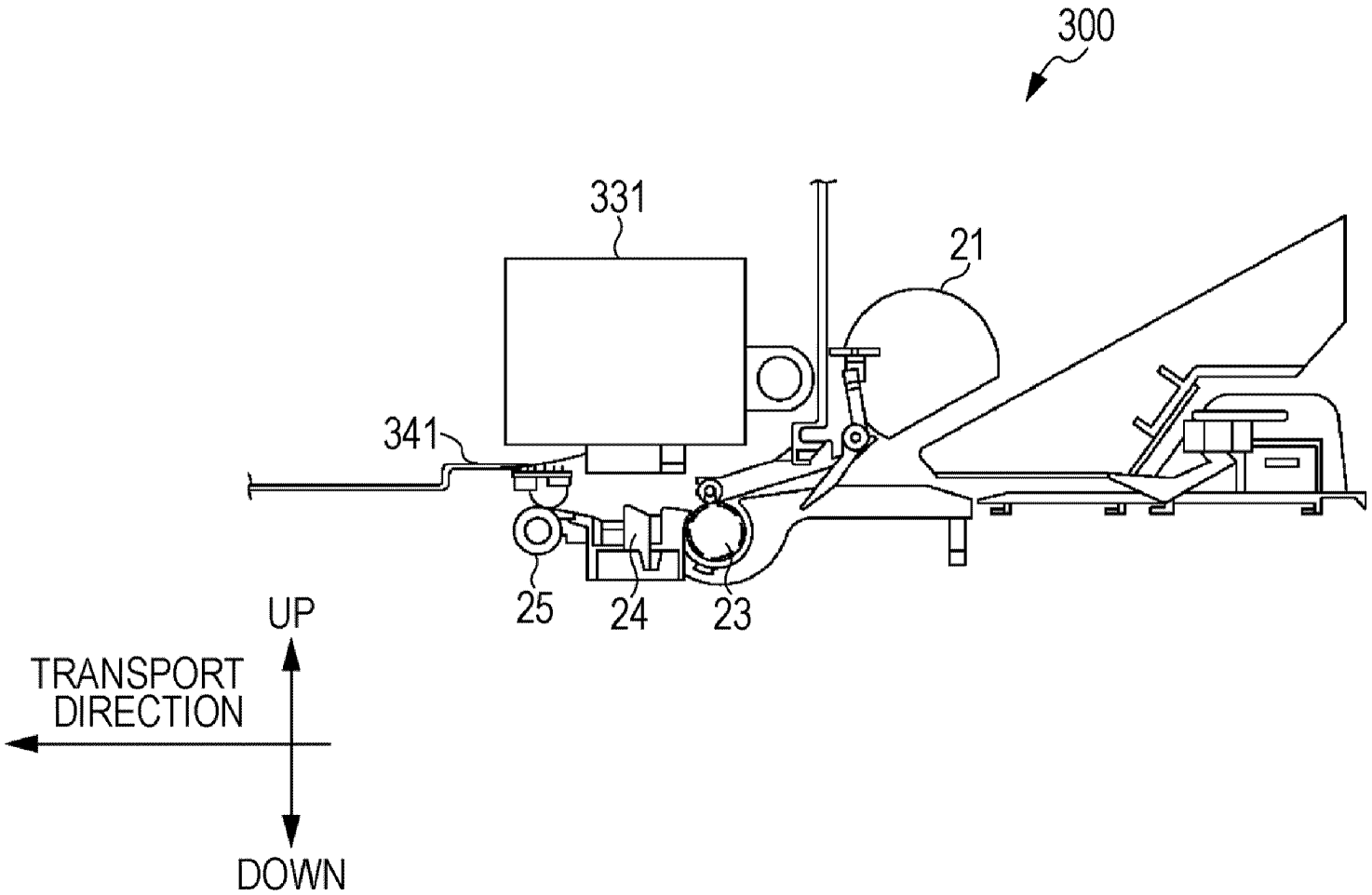
FIG. 10B is a sectional view of the overall structure of a printer.

FIG. 10A is a schematic diagram of the overall structure of the serial type printer 1. Furthermore, FIG. 10B is a sectional view of the overall structure of the printer 300. Hereinafter, description will be made focusing on the differences from the printer 1.

The printer 300 includes a carriage unit 330. The carriage unit 330 is to move a head 340 in the paper width direction. The carriage unit 330 has a carriage 331 and a carriage motor 332. The carriage 331 is capable of reciprocating in the paper width direction and is driven by the carriage motor 332. In addition, the carriage 331 maintains an ink cartridge, which contains an ink as one example of a liquid, in a removable manner.

The head unit 340 jets the ink to the paper S. The head unit 340 includes a head 341 with a plurality of nozzles. Because the head 341 is installed in the carriage 331, when the carriage 331 moves in the paper width direction, the head 341 also moves in the paper width direction. In addition, the head 341 intermittently jets the ink during movement in the paper width direction, so that the dot rows (raster lines) along the paper width direction are printed on the paper S.

Meanwhile, when printing is performed on the paper S, the printer 300 alternately repeats a dot forming operation in which ink is jetted from the nozzles of the head 341 moving in the paper width direction so as to form the dots on the paper S, and a transport operation in which the paper S is transported by the transport unit 20 in the transport direction. At the time of the dot forming operation, ink is intermittently jetted from the nozzles, so that the dot row including the plurality of the dots along the paper width direction is formed. This dot row is referred to as a raster line. The raster direction (corresponding to the "relative movement direction") of this raster line is identical to the paper width direction.

Figure 11:
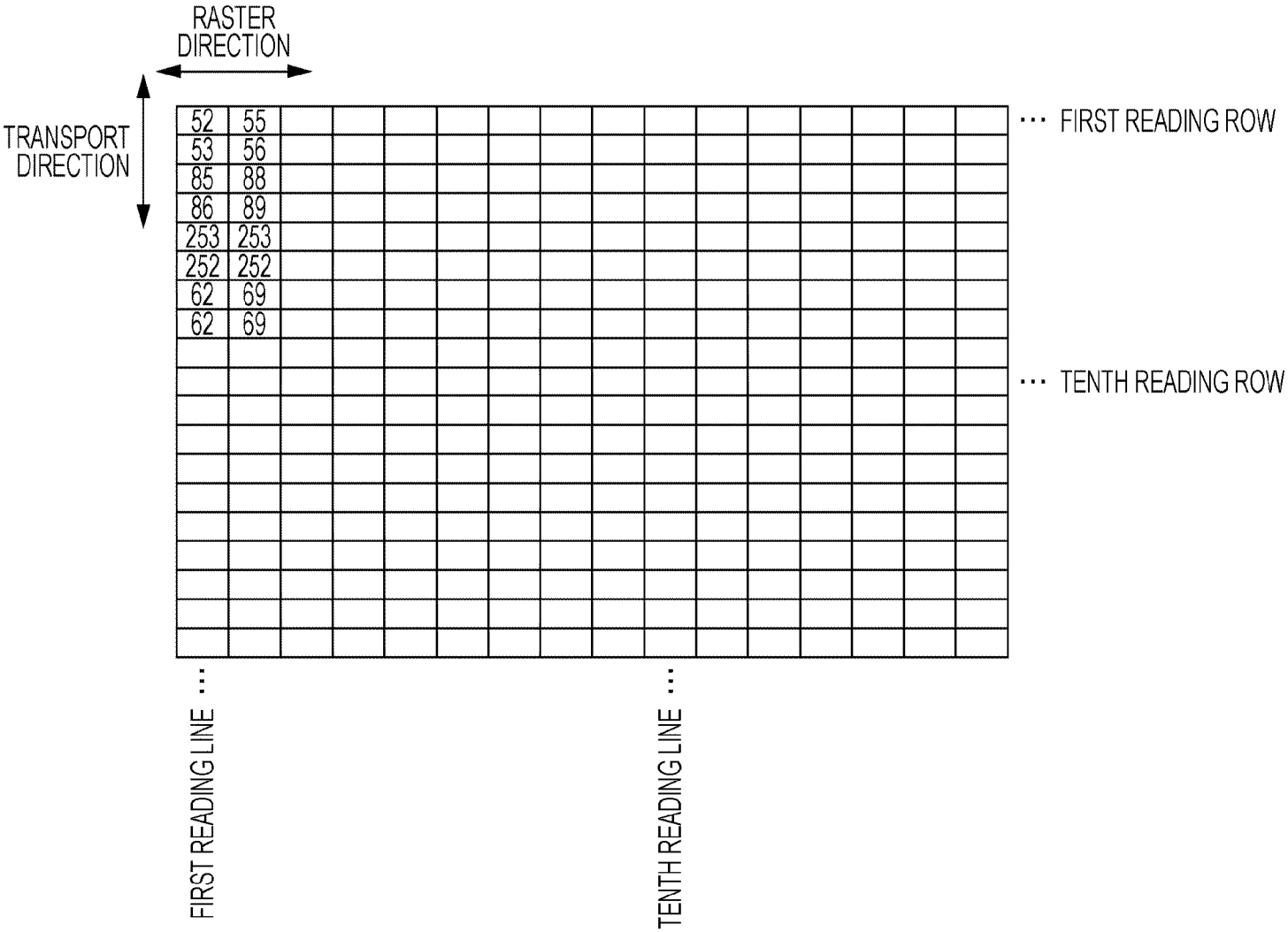
FIG. 11 is a diagram illustrating reading data read by the scanner when the scan rate is 7 ms.

FIG. 11 is a diagram illustrating the reading data read by the scanner 210 when the scan rate is 7 ms. As shown in FIG. 11, the reading data is obtained, by connecting the positions of the cell with the pixel values read at the positions, with respect to the cell in which a plane is partitioned in a quadrille shape for the raster direction and the transport direction. Namely, while in the first embodiment, the plane is partitioned in a quadrille shape for the raster direction and the paper width direction, the second embodiment differs in that the plane is partitioned in a quadrille shape for the raster direction and the transport direction, but in other respects is identical to the first embodiment.

The flow of the discharge defect detection processing in the second embodiment is identical to the processing flow shown in FIG. 9.

As described above, with the second embodiment, the reading resolution to the raster direction is made to be low at the time of reading with the scanner 210, while maintaining the accuracy of the discharge defect detection, whereby the amount of processing data in the discharge defect detection can be reduced.

THIRD EMBODIMENT

In the first and second embodiments, the standard data has been written by digital processing of the image data (S906 in FIG. 9). On the other hand, in a third embodiment, when a number of identical images are printed, the standard data is written by reading the prints, which have been printed immediately after cleaning or flushing of the head unit 40, with the scanner 210. Namely, nozzle clogging does not occur immediately after cleaning or flushing so that the prints having an excellent image data without dot defects can be obtained. The data that has been read from the prints having a high definition can fulfill the function of the standard data.

As described above, with the third embodiment, the reading resolution to the raster direction is made to be low at the time of reading with the scanner 210, while maintaining the accuracy of the discharge defect detection, whereby the amount of processing data in the discharge defect detection can be reduced.

OTHER EMBODIMENTS

In addition, although, in the above embodiments, descriptions have been given for the printers 1 and 300, which discharge the ink to form an image, as one example of the fluid discharge device, it is not limited thereto, but may also be embodied in the discharge defect detection of a fluid discharging device that discharges different fluids (including a liquid, a liquefied body with particles of function materials being dispersed therein, a liquefied material such as a gel, and a pulverulent body being an aggregate of minute powders) other than the inks.

For example, it may be discharge defect detection relating to a fluid discharging device that discharges fluids including, in a dispersed or solved state, materials such as electrode materials and color materials, which are used for manufacturing a liquid crystal display, an EL (electro luminescence) display and a surface-emitting display or the like, a fluid discharging device that discharges living body organic matters used for manufacturing a bio chip, and a fluid discharging device that discharges a fluid becoming a sample used as a precision pipette. In addition, it may be a fluid discharging device that discharges a lubricant oil to precision machinery such as a watch and a camera with a pin point, a discharge defect detection of a fluid discharging device that discharges a transparent resin liquid such as an ultraviolet curing resin onto a substrate so as to form a minute hemisphere lens (optical lens) or the like used for optical communication elements or the like, a fluid discharging device that discharges an etching liquid such as an acid or an alkali so as to etch a substrate or the like, and a fluid discharging device that discharges a gel. The embodiments of the invention are applicable to the discharge defect detection of any one type of the fluid discharging devices.

The embodiments described above are to facilitate understanding of the invention, but not to interpret the invention in a limited manner. The present invention can be modified and improved without departing from the gist thereof and at the same time equivalents thereof are included in the invention. In particular, embodiments described hereinafter are also included in the invention.

Head

In the above-described embodiments, the head 41 that discharges ink using a piezoelectric element has been used. However, for the method of discharging the fluid is not limited thereto. For example, another method such as a method of generating bubbles in the nozzles by heat may be used.

What is claimed is:

1. A discharge defect detecting device comprising:

a sensor that reads an image, which has been formed on a medium by moving nozzles relative to the medium in a relative movement direction and discharging a fluid, at a reading resolution lower than the resolution of an image data in the relative movement direction, based on the image data, a standard data forming unit that forms standard data having the same resolution as the reading resolution in the relative movement direction, based on the image data, and a detecting unit that compares a plurality of the reading data pixels on the same reading row in the relative movement direction in the data read by the sensor with a plurality of standard data pixels each corresponding to the plurality of the reading data pixels in the standard data, to detect discharge defects of at least one of the nozzles.

2. The discharge defect detecting device according to claim 1, wherein the discharge defects of the nozzles are detected by comparing the plurality of the reading data pixels on the same row in the relative movement direction with the plurality of the standard data pixels each corresponding to plurality of the reading data pixels for all of the rows.

3. The discharge defect detecting device according to claim 1, wherein, when the reading data pixels are compared with the standard data pixels to detect the discharge defects of at least one of the nozzles, a difference between the pixel values of the plurality of the reading data pixels on the same reading row in the relative movement direction and the pixel values of the plurality of the standard data pixels each corresponding to the plurality of the reading data pixels is calculated, and wherein it is judged by the detecting unit that a discharge defect exists in at least one of the nozzles when, among the reading lines in the reading row for which the difference is greater than or equal to $\alpha$, where $\alpha$ is a first predetermined ratio value of the standard data pixels, the difference is equal to or greater than $\beta$, where $\beta$ is a second predetermined ratio value of the standard data pixels.

4. The discharge defect detecting device according to claim 3, wherein when it is judged that at least one discharge defect exists in the nozzles, among the plurality of the standard data pixels on the same reading row in the relative movement direction, the larger the value $\alpha$, the larger the value $\beta$ is.

5. The discharge defect detecting device according to claim 1, wherein the sensor reads so that the reading resolution is higher than the resolution of the image data in a direction intersecting with the relative movement direction.

6. The discharge defect detecting device according to claim 1, wherein the standard data are formed by data processing of the image data.

7. The discharge defect detecting device according to claim 1, wherein printing is performed by the discharge defect detecting device based on the discharge detection results.

8. A discharge defect detecting method comprising:

reading an image, which has been formed on a medium by discharging a fluid with nozzles which are being moved relative to the medium in a relative movement direction, with a sensor so that a reading resolution is lower than a resolution of image data in the relative movement direction, based on the image data, forming standard data having the same resolution as the reading resolution in the relative movement direction, based on the image data, and comparing a plurality of reading data pixels on the same reading row in the relative movement direction in the data read by the sensor with the plurality of standard data pixels each corresponding to the plurality of the reading data pixels in the standard data, to detect the discharge defects of at least one of the nozzles.

* * * * *